US008261822B2

(12) United States Patent
Jordy

(10) Patent No.: US 8,261,822 B2
(45) Date of Patent: Sep. 11, 2012

(54) FLOW REGULATOR ASSEMBLY

(75) Inventor: Dustin R. Jordy, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 417 days.

(21) Appl. No.: 12/581,605

(22) Filed: Oct. 19, 2009

(65) Prior Publication Data

US 2010/0096127 A1 Apr. 22, 2010

Related U.S. Application Data

(60) Provisional application No. 61/107,247, filed on Oct. 21, 2008.

(51) Int. Cl.
*E21B 43/16* (2006.01)
*E21B 43/25* (2006.01)

(52) U.S. Cl. ..... 166/269; 166/306; 137/504

(58) Field of Classification Search ..... 166/269, 166/306, 242.5; 137/504
See application file for complete search history.

(56) References Cited

U.S. PATENT DOCUMENTS

| | | | | |
|---|---|---|---|---|
| 2,646,078 | A * | 7/1953 | Adams | 138/43 |
| 3,319,717 | A * | 5/1967 | Chenoweth | 166/115 |
| 3,381,708 | A * | 5/1968 | Chenoweth | 137/504 |
| 4,640,355 | A | 2/1987 | Hong | |
| 4,651,822 | A * | 3/1987 | Johnston et al. | 166/117.5 |
| 4,858,644 | A * | 8/1989 | Decker | 137/504 |
| 6,343,651 | B1 | 2/2002 | Bixenman | |
| 7,350,577 | B2 | 4/2008 | Howard | |
| 7,419,003 | B2 | 9/2008 | Russell | |
| 7,426,962 | B2 | 9/2008 | Moen | |

* cited by examiner

*Primary Examiner* — Giovanna Wright
(74) *Attorney, Agent, or Firm* — Bracewell & Giuliani LLP

(57) ABSTRACT

A system for and method of supplying an injection fluid to a well assembly so that the injection fluid flows at a substantially constant flow rate. The fluid can be injected at a single site in the well assembly or multiple sites. A flow control regulator is included that attaches to the well assembly and provides a self adjusting flow control for the fluid being injected. The regulator includes a slidable floating sleeve having an orifice through which the fluid flows. The sleeve includes an inlet port that can register with a fluid supply port to allow the injection fluid to make its way into the sleeve. The fluid exits the sleeve through the orifice to generate a pressure differential across the orifice that in turn exerts a sliding force onto the sleeve. Moving the sleeve misaligns the inlet port and fluid supply port thereby throttling flow through the regulator to a predetermined flow rate.

13 Claims, 5 Drawing Sheets

FLOW REGULATOR ASSEMBLY

CROSS-REFERENCE TO RELATED APPLICATIONS

The present application relates to U.S. provisional application 61/107,247 filed on Oct. 21, 2008, the entire specification of which being herein incorporated by reference.

BACKGROUND

1. Field of the Invention

This invention relates in general to oil and gas production, and in particular to a multi-ported flow regulator used for injecting fluid into a wellbore.

2. Description of Related Art

Oil and gas production involves extracting hydrocarbons from a subterranean formation in which they are entrained. The hydrocarbons, either in liquid (oil) or gas form, flow to the surface within a wellbore that intersects the formation. Other fluids, such as water, $CO_2$, $N_2$, and $H_2S$, may be included in the formation with the hydrocarbons. An injection fluid, which is typically different from the produced fluid, is sometimes used during the production of fluids from subterranean formations. The injection fluid(s) can be added at a wellhead mounted on top of the wellbore, within the wellbore, or into the formation, the injection location depends on why the injection fluid is being used.

Often, the fluids that are injected into the formation or deep in the wellbore are to enhance production. For example, a lower viscosity fluid can be injected into the produced fluid, in the formation or production tubing in the wellbore, to decrease the viscosity of the fluid being produced and reduce flow drag. A lower density fluid can be injected to reduce production fluid density thereby increasing its flow rate. Injection fluids can also be used to treat the formation for enhancing flow. Certain injection fluids can etch the formation and increase flow capacity through pores in the formation. Other injection fluids can aid in the separation of polar and non-polar compounds and aid in the extraction of the produced fluids from the formation. Formation pressure can be maintained or increased by injecting a higher pressure fluid into the formation. In some instances, increasing formation pressure can enhance flow of produced fluids from the formation. Examples of injection fluids include rust inhibitors, chemical treatments, surfactants, steam, water, grease, natural gas, brine, and alcohol.

Fluid injection may occur at more than one location in the well, where the different locations are at different pressures. Additionally, the flow rate of fluid injection at each location may differ. Individual supply lines may be provided that extend from the surface directly to each injection point. This may be problematic due to space limitations within the wellbore and at the wellhead.

SUMMARY OF THE INVENTION

Disclosed herein is a method of injecting fluid into a well that includes isolating first and second formations in a well from one another, extending conduit from a wellhead assembly into the well, the conduit having a first port in fluid communication with the first formation and a second port in fluid communication with the second formation, pumping fluid down the conduit and to the ports, and controlling flow through each of the ports so that the flow rates through each of the ports is substantially constant as the pressure difference between the conduit and the first and second formations vary. Fluid discharged from the first port and from the second port can be at different pressures. Each port can have a flow control device with a variable flow area that varies in inverse proportion to the pressure in the conduit. The method can further include setting a packer between the first and second formations as well as mounting a flow control device in each of the ports on the exterior of the conduit. The injection fluid can be acid, water, steam, gas, brine, surfactants, rust inhibitors, scale treatment fluids, alcohol, or combinations thereof. In one example, the injection fluid is maintained at a subcritical condition.

A fluid injection system for injection into a subterranean well is also described herein. In one example the fluid injection system includes a fluid source, a fluid supply line in fluid communication with the fluid source, a first flow control regulator in fluid communication with the fluid supply line and having a discharge in pressure communication with a first location within subterranean well, so that when the fluid source supplies fluid to the fluid supply line, the fluid exits from the discharge to the first location within the subterranean well at a constant flow rate, and a second flow control regulator in fluid communication with the fluid supply line and having a discharge in pressure communication with a second location within the subterranean well that has a pressure different from the first location, so that when the fluid source supplies fluid to the fluid supply line, the fluid exits from the discharge to the second location within the subterranean well at a constant flow rate. The location in the subterranean well can include a wellhead housing, a production tree, an annulus between wellbore tubulars, and within production tubing. The fluid can exit from the discharge at a constant flow rate over a range of pressures in the fluid supply line and the locations in the subterranean well. The flow control regulators can include a flow path with a selectively changeable flow area. In an alternative example, the flow control device has an inlet, a fixed sleeve in fluid communication with the inlet, a fixed port formed through a side of the fixed sleeve, a floating sleeve coaxial and slidable with respect to the fixed sleeve, a floating port formed through a side of the floating sleeve and selectively registerable with the fixed port, a restriction orifice on an end of the floating sleeve in fluid communication with the floating port, and a compressible resilient member in contact with the restriction orifice on a side of the restriction orifice opposite the fixed sleeve, so that when injection fluid is directed to the inlet of the flow control device, the fluid flows to the fixed sleeve, through the registered fixed and floating ports, and through the restriction orifice to generate a pressure differential across the restriction orifice that creates a force to slide the floating sleeve away from the fixed sleeve misalign the floating port and fixed port that in turn reduces the flow area through the flow control device. The injection fluid can be acid, water, steam, gas, brine, surfactants, rust inhibitors, scale treatment fluids, alcohol, or combinations thereof.

Included with the present disclosure is a method of treating a well assembly with an injection fluid that includes providing a constant flow valve made up of, an inlet, a discharge, a flow path between the inlet and discharge, a passage in the flow path, a slidable sleeve having a side wall adjacent and normal to the passage, an orifice in the flow path attached to an end of the slidable sleeve, so that when fluid flows through the orifice a resultant force is produced that can slide the sleeve in a first direction that moves the side wall of the sleeve over a portion of the passage. The method of this embodiment further includes applying a limiting force on the sleeve in a second direction that is opposite the first direction, providing fluid communication between the discharge and a location in the well assembly, and delivering a pre-selected amount of injection fluid to the well assembly and at a substantially constant flow rate by supplying an injection fluid to the inlet

BRIEF DESCRIPTION OF THE SEVERAL VIEWS OF THE DRAWING

Some of the features and benefits of the present disclosure having been stated, others will become apparent as the description proceeds when taken in conjunction with the accompanying drawings, in which.

Figure 1:
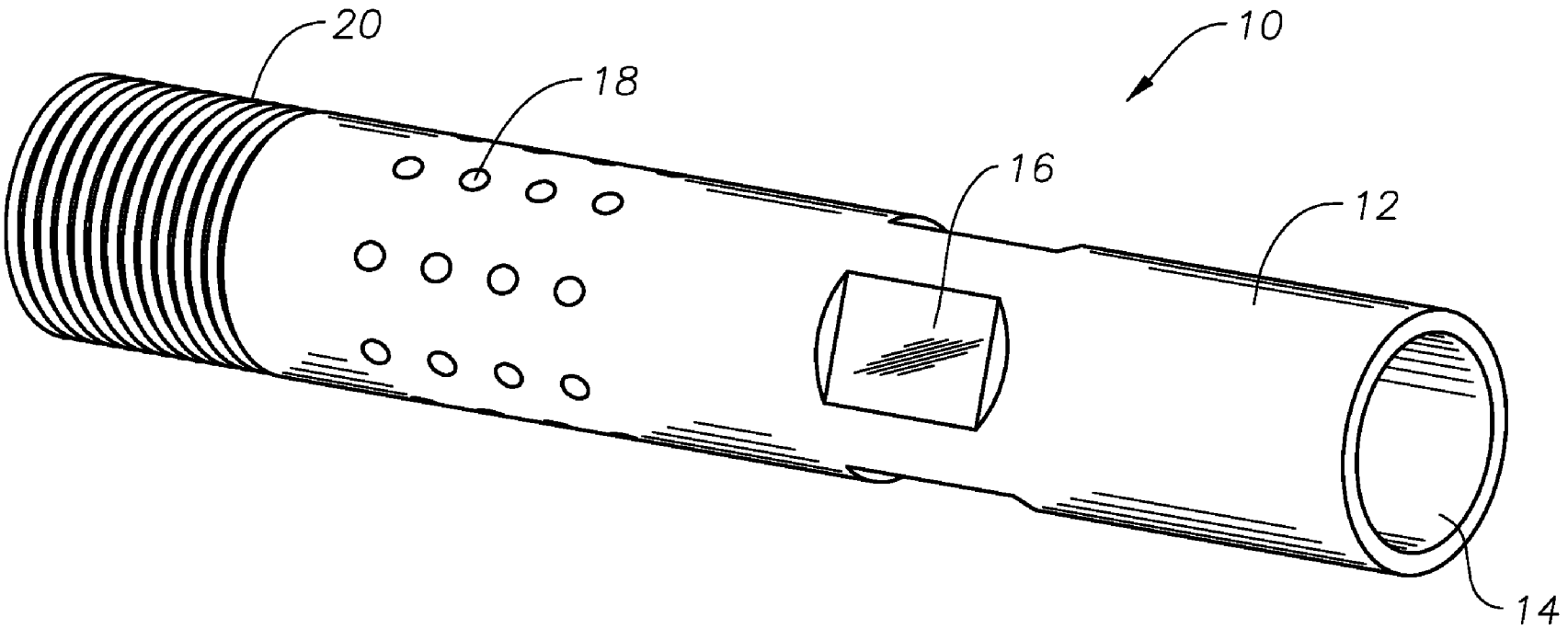
FIG. 1 is side perspective view of an embodiment of a flow regulator constructed in accordance with the present invention.

While the subject device and method will be described in connection with the preferred embodiments but not limited thereto. On the contrary, it is intended to cover all alternatives, modifications, and equivalents, as may be included within the spirit and scope of the present disclosure as defined by the appended claims.

DETAILED DESCRIPTION OF THE INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be through and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

FIG. 1 illustrates a perspective view of an embodiment of a flow regulator 10 as described herein. The flow regulator 10 includes a generally tubular body 12 having an opening 14 on one end and a threaded connection 20 on its opposite end. On the body 12 are optional wrench flats 16 having a generally planar surface locally altering the cylindrical surface of the body 12. The flats 16 can be arranged around the body 12 circumference to provide a surface for engagement by a wrench or other hand tool for tightening or loosening the flow regulator 10. As will be described in more detail below, the opening 14 of the flow regulator 10 is attachable to a fluid source. Fluid from the fluid source can enter the opening 14 and flow through the body 12; the fluid can be selectively regulated to a specified pressure or pressure range. Fluid within the body 12 can exit through exit ports 18 shown on the outer surface of the body 12.

Figure 2:
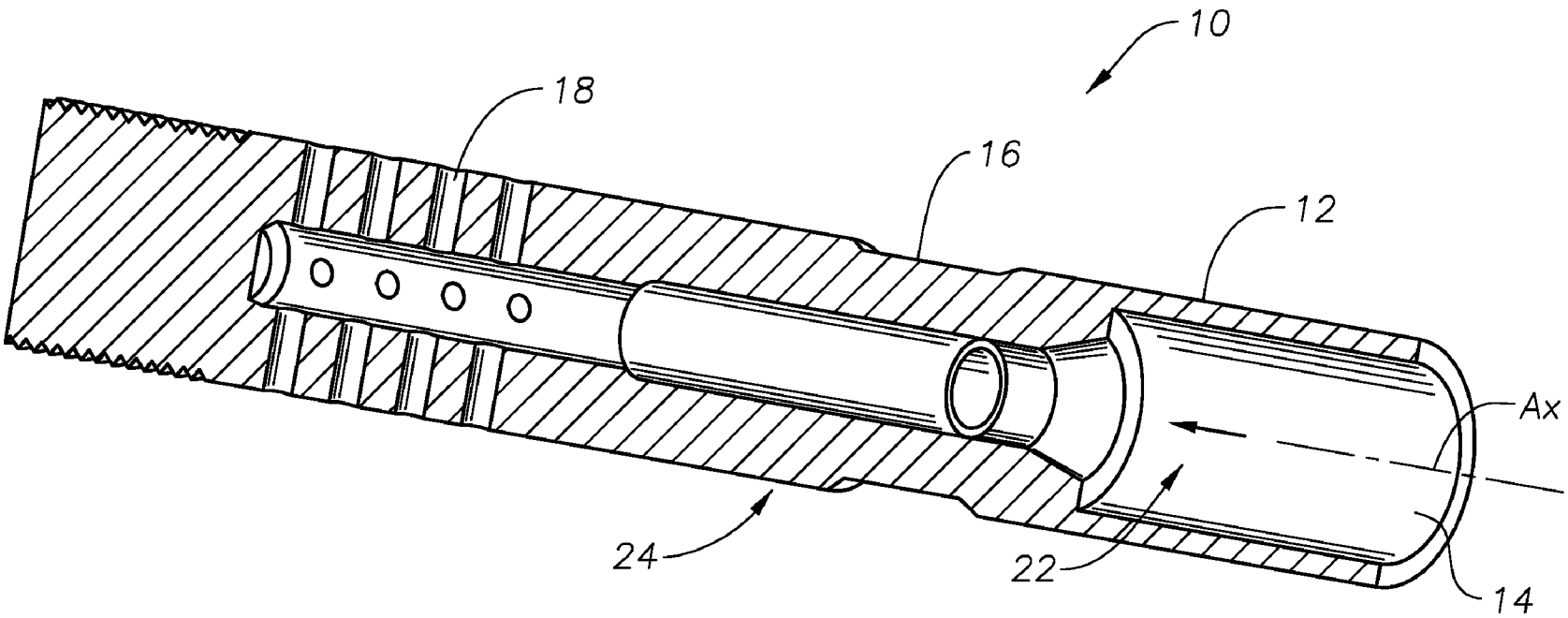
FIG. 2 is a partial sectional view of the flow regulator of FIG. 1.

A partial section view of the flow regulator 10 is shown in perspective view in FIG. 2. As shown, a bore 22 in the body 12 extends from the opening 14 and has a closed end at the exit ports 18. An arrow provided in the bore 22 represents fluid flow direction within the bore 22. Thus for the purposes of discussion herein, the arrow points in a downstream direction. Conversely, upstream is designated as being in a direction opposite that of the arrow. Thus using this convention, the opening 14 is upstream of the exit ports 18. The bore 22 as shown includes a series of transitions that begin upstream of the wrench flats 16, thereby narrowing the diameter of the bore 22. In the embodiment shown, a constant flow valve 24 is housed in a narrowed portion of the bore 22. Modular embodiments of a constant flow valve 24 are available for purchase. One example for use is a Flosert™ valve from The Lee Company, USA, Pettipaug Rd, P.O. Box 424, Westbrook, Conn., 06498-0424.

Figure 3:
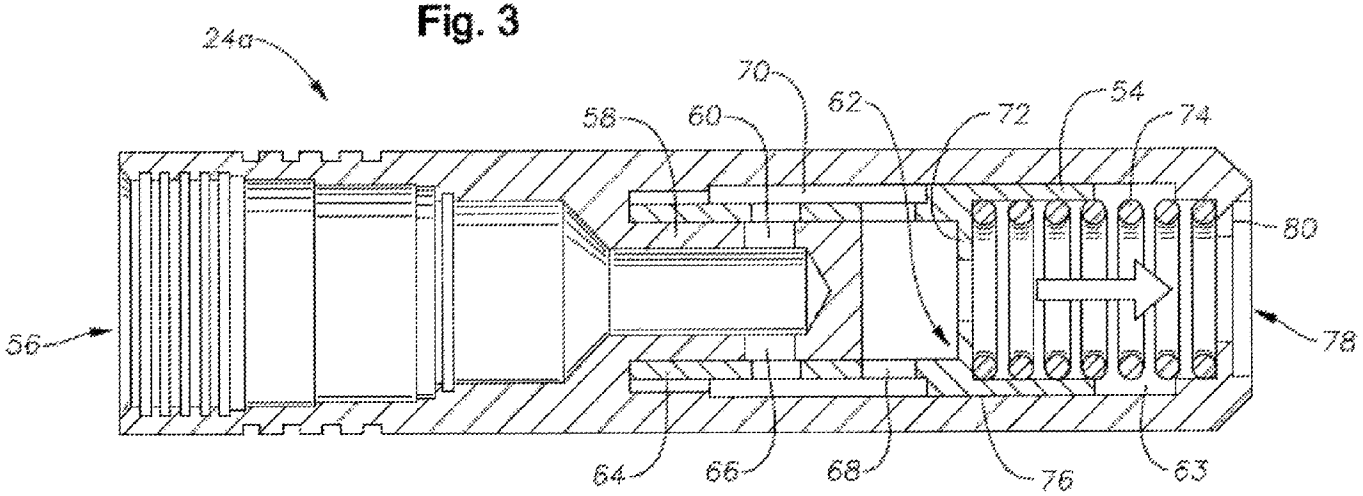
FIG. 3 is a schematic view of an alternative embodiment of a constant flow valve.

An alternate example of a constant flow valve 24A is shown in a side sectional view in FIG. 3. The constant flow valve 24A includes a tubular body 54 with an inlet 56 formed through an end of the body 54. Shown coaxially anchored within the body 54 is an annular fixed sleeve 58 with an open end facing the inlet 56 and an inner diameter less than the diameter of the inlet 56. The sleeve 58 is closed on the end opposite the inlet 56. The connection anchoring the fixed sleeve 58 extends continuously from the body 54 to the open end of the fixed sleeve 58 so that any flow entering the inlet 56 is directed to within the fixed sleeve 58. Ports 60 are shown formed radially through the fixed sleeve 58. A floating orifice 62 is shown within the body 54 that coaxially circumscribes the fixed sleeve 58 and projects past the closed end of the sleeve 58 into a discharge annulus 63. A sleeve portion 64 of the floating orifice 62 circumscribes the fixed sleeve 58, ports 66 is shown radially formed through the sleeve portion 64 that register with the ports 60 in the fixed sleeve 58. Additional ports 68 are shown provided within the sleeve portion 64. Defined in the annular space between the sleeve portion 64 and body 54 is an annulus 70 that communicates with ports 66 and ports 68 on the outer surface of the sleeve portion 64. Ports 68 are in communication with the discharge annulus 63 on the inner surface of the sleeve portion 64. Thus fluid entering the constant flow valve 24A through its inlet 56, can flow within the fixed sleeve 58, through the registered ports 60, 66, into the annulus 70, then through ports 68 and into the discharge annulus 63.

The floating orifice 62 includes an orifice element 72 shown disposed downstream of the ports 68 within the discharge annulus 63. A spring 74 is coaxially disposed in the discharge annulus 63 shown partially circumscribed by a forward sleeve 76 extending axially from the orifice 72 and away from the inlet 56. The discharge annulus 63 includes an outlet 78 at its end opposite the fixed sleeve 58. One end of the spring 74 contacts the downstream side of the orifice 72 and the other end of the spring 74 contacts a flange 80 shown projecting radially inward from the body 54 adjacent the outlet 78.

In one example of use, fluid that enters the flow regulator 10A is directed to the inlet 56 and to within the fixed sleeve 58. From the fixed sleeve 58 the fluid can flow through the registered ports 60, 66, the annulus 70, and the ports 68 and into the discharge annulus 63. Within the discharge annulus 63, the fluid flows through the restricted diameter orifice 72 before exiting the constant flow valve 24A. Restricting flow through the orifice 72 creates a pressure differential across the orifice 72 that translates into a force to urge the floating orifice 62 downstream and compress the spring 74. As the floating orifice 62 is moved downstream, the ports 60, 66 become misaligned thereby reducing the effective flow area through the valve 24A. The reduced flow area reduces flow through the ports 60, 66 that in turn decreases the pressure differential across the orifice 72. When the pressure drop across the orifice 72 and spring force are substantially the same the floating orifice 62 will stabilize and cease to move thereby maintaining a constant flow rate of fluid through the constant flow valve 24A.

Figure 4:
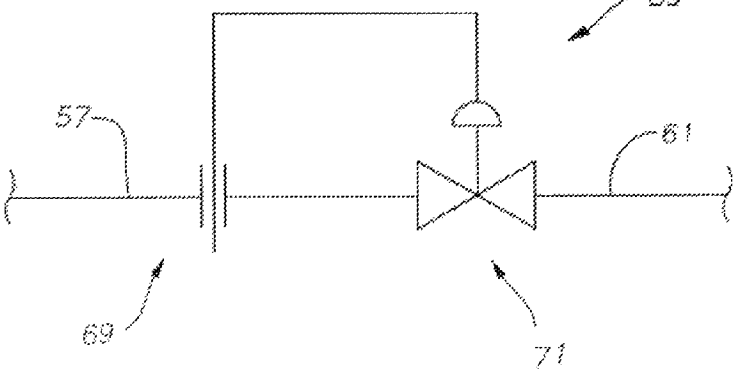
FIG. 4 is a partial sectional view of a flow regulator on tubing.

An alternative constant flow control device is illustrated in a schematic view in FIG. 4. In this embodiment, injection fluid from the injection fluid source flows through an inlet line 57 to a control valve assembly 59. The inlet line 57 can connect directly to the source, the fluid supply line 50, as well as a lead line 49. The assembly 59 includes a flow meter 69 upstream of a control valve 71, wherein the flow meter 69 measures the flow rate and communicates to the control valve 71 to increase or decrease the flow path (not shown) through the control valve 71, thereby maintaining a constant flow rate of injection fluid. An exit line 61 is depicted downstream of the control valve; the exit line 61 can terminate at a base 11 located on the wellbore assembly 40, or alternatively the control valve can couple directly to the base 11.

Figure 5:
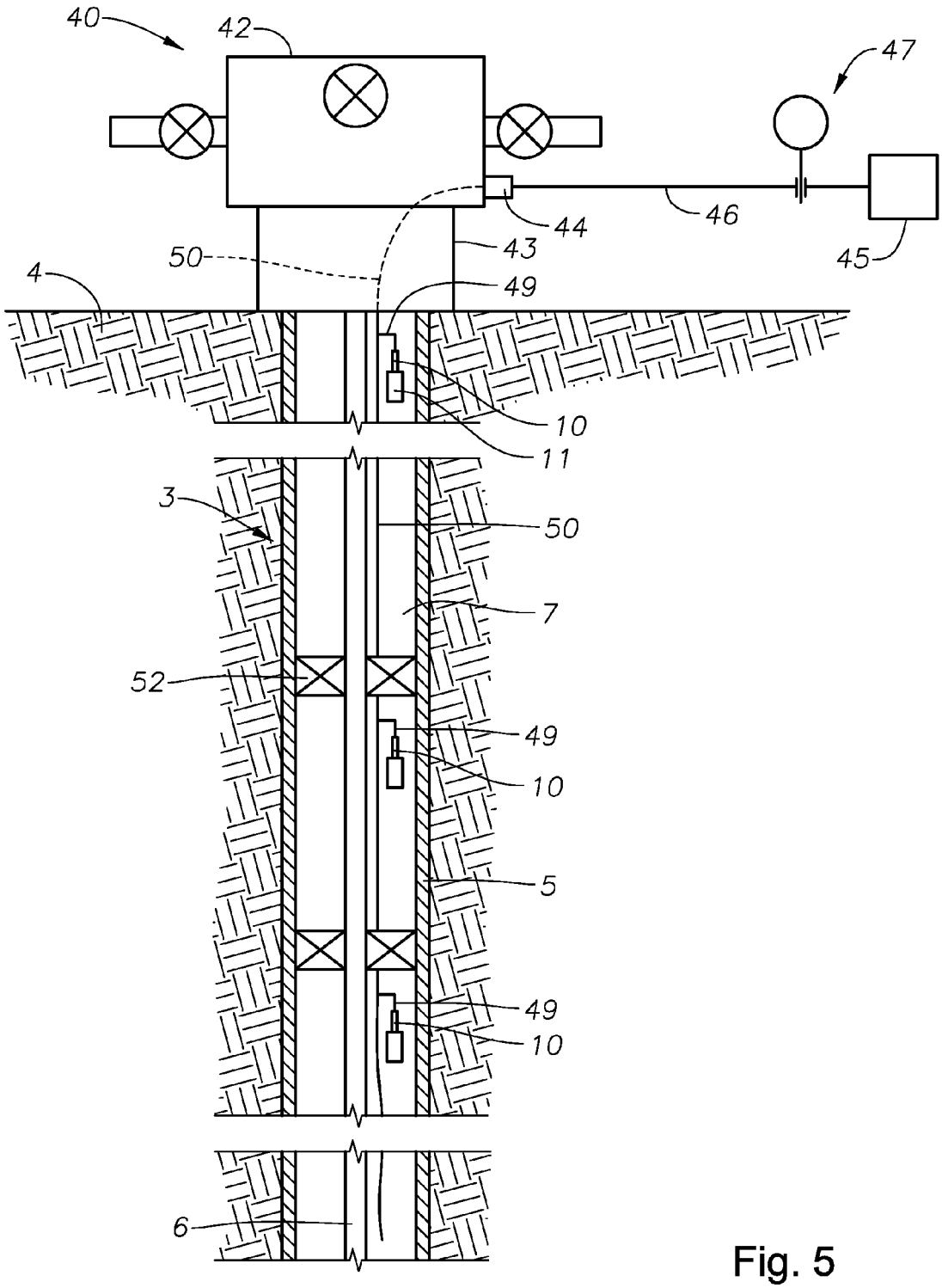
FIG. 5 is a partial sectional side view of a wellhead assembly that includes a flow regulator.

With reference now to FIG. 5, an example of a wellbore assembly 40 is depicted in a side partial sectional view. The wellbore assembly 40 includes a production tree 42 and wellhead housing 43 mounted over a wellbore 3 that intersects a subterranean formation 4. The wellbore 3 is shown lined with casing 5 and production tubing 6 within the casing 5 to form an annulus 7 between the tubing 6 and the casing 5. The casing 5 and tubing 6 are suspended into the wellbore 3 from the wellhead housing 43. Packers 52, shown in sectional view, are at locations in the wellbore 3 and extend between the tubing 6 outer diameter to the casing 5 inner surface. For the sake of illustration a single casing 5 and tubing 6 are depicted, however embodiments of the present disclosure include wellbore assemblies 40 having more than one string of casing 5 as well as more than one string of production tubing 6.

Examples of pressure regulators 10 are shown disposed within the wellbore 3 at multiple locations. The regulators 10 may be threadingly connected to a base 11 shown within the annulus 7. An injection line 46 for transporting an injection fluid or fluids is illustrated that conveys injection fluid from an injection fluid source 45 to the production tree 42. The injection line 46 can optionally include a flow meter 47 between the source 45 and the production tree 42. The end of the injection line 46 opposite the fluid source is shown connected to an injection port 44 mounted in the production tree 42. Examples of injection fluid include acid, water, steam, gas, brine, surfactants, rust inhibitors, scale treatment fluids, alcohol, and combinations thereof, to name but a few. An injection fluid supply line 50 in fluid communication with the injection port 44 is shown passing through the production tree 42 and wellhead housing 43 and into the borehole 3. Each regulator 10 is in fluid communication with the fluid supply line 50 via lead lines 49 shown connected between the fluid supply line 50 and the opening 11 of each regulator 10.

In one mode of operation, an injection fluid is provided through line 46 where it flows through the injection port 44 and into the fluid supply line 50. After branching into the lead lines 49 the injection fluid is introduced to the regulator 10 via the opening 14 (FIG. 2). The fluid flow through the flow regulator 10 is maintained substantially constant. One of the advantages of the system described herein is the ability to provide downhole an injection flow of substantially constant flow rate, irrespective of supply pressure of the injection fluid or back pressure at the exit ports 18. Moreover, multiple injection points, as illustrated in FIG. 5, can be serviced with a single injection line at a given supply pressure by tailoring each pressure regulator 10 as described above. Thus significant advantages can be realized by selectively injecting a desired injection flow while limiting the number of fluid lines within the wellbore assembly 40.

An additional advantage is the modular design of the flow regulator 10. The constant flow valve 24 used in the flow regulator 10 described herein is readily interchangeable with a constant flow valve 24 rated for a different operating capability. Additionally, a constant flow valve 24 having a certain operating capability can be installed after being manufactured, such as on site at an oil/gas well. One example of a different operating capability includes a fluid flow rate across the constant flow valve 24. The readily interchangeable design, or ready installation, provides flexibility to meet operating conditions that may not be known or available before the regulator 10 is manufactured or delivered for use. Multiple exit ports 18 provided on the body 12 provide another advantage since injection nozzles downhole can clog from scale buildup or other debris in wellbore fluid. The plurality of ports 18 provides redundant exit points on the regulator 10 thereby significantly reducing the chances of clogging.

Figure 6:
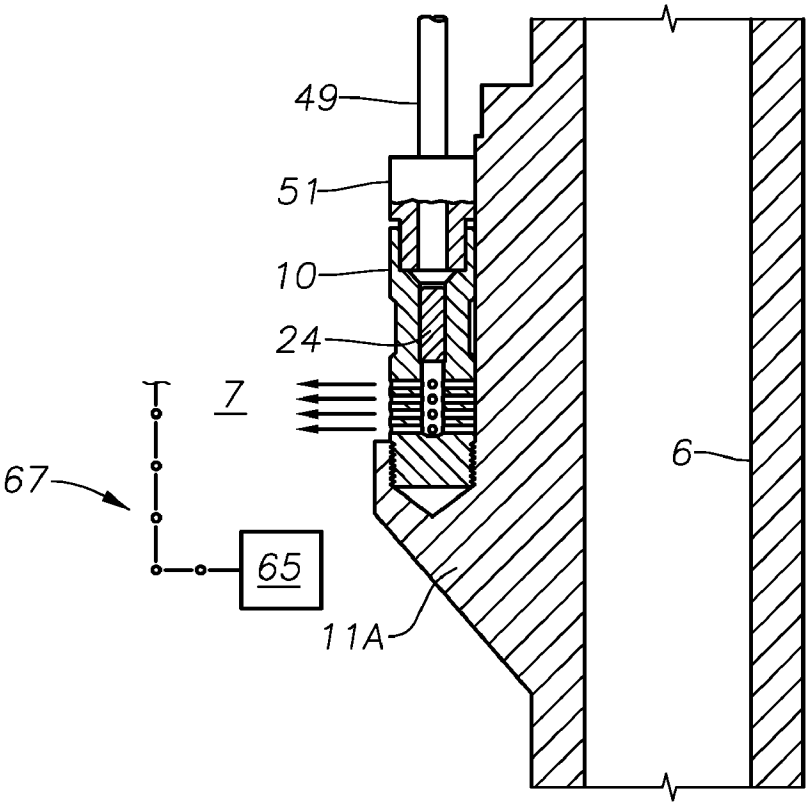
FIG. 6 is a sectional view of an example of a constant flow valve within the flow regulator.

The pressure regulators 10 are illustrated in FIG. 5 within the annulus 7; however embodiments exist where the regulators 10 are connected directly to tubing, casing, the production tree, or wellhead housing. With reference to FIG. 6, an example of the flow regulator 10 is shown attached to a base 11A on the tubing 6 outer wall. The flow exiting the regulator 10 (represented by arrows) discharges into the annulus 7. A connector 51 couples the lead line 49 to the regulator 10. The base 11A of FIG. 6 can be attached to the tubing 6 or integrally formed with the tubing 6. A receptacle having an axis shown substantially parallel to the tubing 6 is formed in the base 11A, where the receptacle includes threads formed to mate with threads on the regulator 10 nose. A pressure gauge 65 is schematically illustrated disposed within the annulus 7 in communication with a communication link 67. The pressure gauge 65, which can be any type, can sense the pressure within the annulus 7 and emit a signal representative of the annulus pressure to the communication link 67. The communication link 67 can include an electrically conductive member as well as a telemetry signal. The signal can be transmitted to the surface and used to independently evaluate the pressure drop across the regulator 10. A controller (not shown) can be included that receives the pressure signal and adjusts the pressure and/or flow rate of the injection fluid at the surface to maintain the regulator 10 within its operating conditions.

Figure 7:
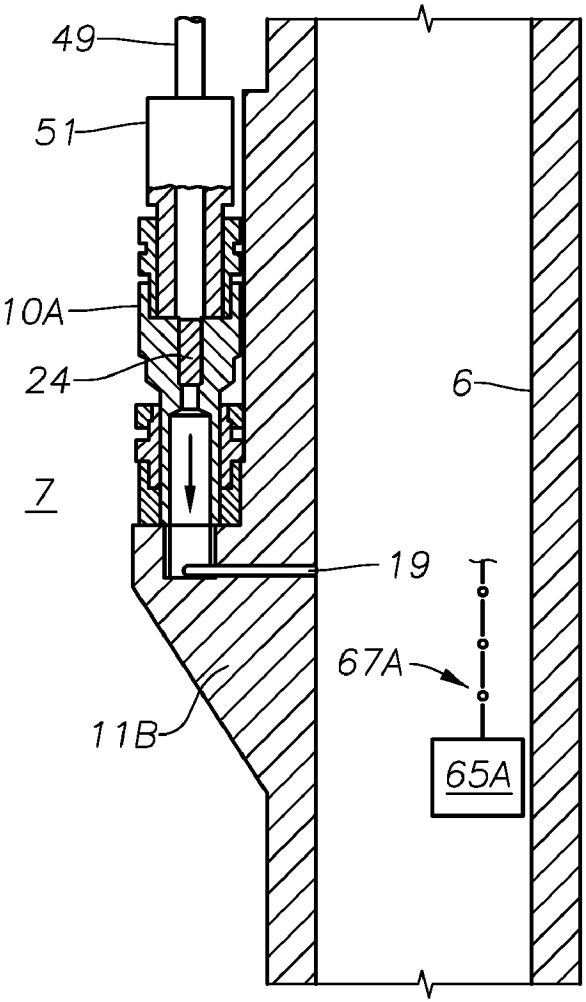
FIG. 7 is a partial sectional view of a flow regulator for regulating flow into tubing.

FIG. 7 illustrates an alternative embodiment of a regulator 10A having flow exiting the regulator through its nose section. The flow is received from the lead line 49, which is shown attached to the flow regulator 10A with a connector 51. The flow enters the flow regulator 10A and is regulated with the constant flow valve 24 within. The discharge from the flow regulator 10A is direct to a discharge passage 19 laterally formed within the base 11B. The passage 19 conveys the injection fluid between the regulator 10A and the tubing 6. In this example, the injection fluid can include fluids to maintain a clean flow through the tubing 6, for example to prevent build up of materials such as asphaltene and/or scale. A pressure gauge 65A and communication link 67A, which can be the same as that of FIG. 6, is shown provided within the tubing 6.

While the invention has been shown in only one of its forms, it should be apparent to those skilled in the art that it is not so limited, but is susceptible to various changes without departing from the scope of the invention. In an alternate embodiment, devices for preventing backflow, such as a check valve, can be included within the lines 46, 50, 49 that convey injection fluid.

What is claimed is:

1. A method of injecting fluid into a well comprising:

(a) isolating first and second formations in a well from one another;

(b) providing flow valves comprising:

a body, a bore substantially coaxial formed through the body to define an inlet at an end of the body and an exit at an end of the body distal from the inlet.

a fixed sleeve in the body having an annular chamber with an open end in fluid communication with the inlet, a sidewall, and a opening that extends radially outward through the sidewall, a sliding sleeve coaxially disposed in the bore having an annular sidewall that coaxially slides over an outer surface of the fixed sleeve, a first opening in the annular sidewall and a second opening in the annular sidewall spaced axially apart from the first opening, wherein the first opening is selectively registerable with the opening in the fixed sleeve, and an orifice in an end of the sliding sleeve distal from the first opening, and a spring biasing the sliding sleeve towards the inlet in the body, (c) extending conduit from a wellhead assembly into the well, the conduit having a first port in fluid communication with the first formation and a second port in fluid communication the second formation and providing a flow valve on each of the first port and second port; and (d) pumping fluid down the conduit and to the ports, so that when the fluid enters the inlets in the flow valves, flows to an annulus circumscribing the sliding sleeve, flows radially inward through the second openings, flows through the orifice and to the outlet in the body when the first openings are in registration with the openings in the fixed sleeve, and so that when the fluid generates a pressure drop through the orifice, the sliding sleeve is moved to reduce an amount of flow through the first openings thereby controlling flow through each of the ports so that the flow rates through each of the ports is substantially constant as the pressure difference between the conduit and the first and second formations vary.

2. The method of claim 1, wherein step (c) comprises discharging fluid from the first port and from the second port at different pressures.

3. The method of claim 1, wherein step (c) comprises providing each of the ports with a flow control device having a variable flow area and causing the flow area to vary in inverse proportion to the pressure in the conduit.

4. The method of claim 1, wherein step (a) comprises setting a packer between the first and second formations.

5. The method of claim 1, wherein step (c) comprises mounting a flow control device in each of the ports on the exterior of the conduit.

6. The method of claim 1, wherein the injection fluid is selected from the group consisting of acid, water, steam, gas, brine, surfactants, rust inhibitors, scale treatment fluids, alcohol, and combinations thereof.

7. The method of claim 1, wherein the injection fluid is maintained at a subcritical condition.

8. A fluid injection system for injection into a subterranean well comprising:

a fluid source;

a fluid supply line in fluid communication with the fluid source;

a first flow control regulator in fluid communication with the fluid supply line comprising:

a body, a bore substantially coaxial formed through the body to define an inlet at an end of the body and an exit at an end of the body distal from the inlet, a fixed sleeve in the body having an annular chamber with an open end in fluid communication with the inlet, a sidewall, and a port that extends radially outward through the sidewall, a sliding sleeve coaxially disposed in the bore having an annular sidewall that coaxially slides over an outer surface of the fixed sleeve , a first port in the annular sidewall and a second port in the annular sidewall spaced axially apart from the first port, wherein the first port is selectively registerable with the port in the fixed sleeve, and an orifice in an end of the sliding sleeve distal from the first port, and a spring biasing the sliding sleeve towards the inlet in the body, so that when the fluid source supplies fluid to the fluid supply line, the fluid exits from the discharge to the first location within the subterranean well at a constant flow rate; and a second flow control regulator in fluid communication with the fluid supply line comprising:

a body, a bore substantially coaxial formed through the body to define an inlet at an end of the body and an exit at an end of the body distal from the inlet, a fixed sleeve in the body having an annular chamber with an open end in fluid communication with the inlet, a sidewall, and a port that extends radially outward through the sidewall, a sliding sleeve coaxially disposed in the bore having an annular sidewall that coaxially slides over an outer surface of the fixed sleeve, a first port in the annular sidewall and a second port in the annular sidewall spaced axially apart from the first port, wherein the first port is selectively registerable with the port in the fixed sleeve, and an orifice in an end of the sliding sleeve distal from the first port, and a spring biasing the sliding sleeve towards the inlet in the body, so that when the fluid source supplies fluid to the fluid supply line, the fluid exits from the discharge to the second location within the subterranean well at a constant flow rate.

9. The fluid injection system of claim 8, wherein the first and second locations in the subterranean well are selected from the group consisting of a wellhead housing, a production tree, an annulus between wellbore tubulars, and within production tubing.

10. The fluid injection system of claim 8, wherein the fluid exits from the discharge at a constant flow rate over a range of pressures in the fluid supply line and the locations in the subterranean well.

11. The fluid injection system of claim 8, wherein the flow control regulators comprise a flow path with a selectively changeable flow area.

12. The fluid injection system of claim 11, wherein when injection fluid is directed to the inlet of the flow control regulator, the fluid flows to the fixed sleeve, through the registered fixed and first ports, and through the restriction orifice to generate a pressure differential across the restriction orifice that creates a force to slide the floating sleeve away from the fixed sleeve to misalign the first port and fixed port that in turn reduces the flow area through the flow control regulator.

13. The fluid injection system of claim 8, wherein the injection fluid is selected from the group consisting of acid, water, steam, gas, brine, surfactants, rust inhibitors, scale treatment fluids, alcohol, and combinations thereof.

* * * * *